US012458849B1

(12) United States Patent
Poropudas

(10) Patent No.: US 12,458,849 B1
(45) Date of Patent: Nov. 4, 2025

(54) INTERACTIVE SPORTS BALL AND SPORTS MANAGEMENT SYSTEM

(71) Applicant: Sstatzz Oy, Helsinki (FI)

(72) Inventor: Jirka Poropudas, Helsinki (FI)

(73) Assignee: Sstatzz Oy, Helsinki (FI)

( * ) Notice: Subject to any disclaimer, the term of this patent is extended or adjusted under 35 U.S.C. 154(b) by 0 days.

(21) Appl. No.: 18/829,475

(22) Filed: Sep. 10, 2024

(51) Int. Cl.
*A63B 43/00* (2006.01)

(52) U.S. Cl.
CPC ..... *A63B 43/004* (2013.01); *A63B 2220/35* (2013.01); *A63B 2220/40* (2013.01); *A63B 2220/62* (2013.01); *A63B 2220/806* (2013.01); *A63B 2220/833* (2013.01); *A63B 2225/50* (2013.01)

(58) Field of Classification Search
CPC ..... A63B 43/004; A63B 2220/35; A63B 2220/40; A63B 2220/62; A63B 2220/806; A63B 2220/833; A63B 2225/50
See application file for complete search history.

(56) References Cited

U.S. PATENT DOCUMENTS 10,213,645 B1 * 2/2019 Wu ..... A63B 24/0003
2015/0382076 A1 * 12/2015 Davisson ..... H04N 21/435 725/62

* cited by examiner

*Primary Examiner* — Peter J Iannuzzi
(74) *Attorney, Agent, or Firm* — ZIEGLER IP LAW GROUP, LLC.

(57) ABSTRACT

An interactive sports ball. The interactive sports ball includes a body: a sensor arrangement having a first sensor, embedded within the body, to measure acceleration data associated with the ball, and a second sensor, embedded within the body, to measure rotational data associated with the ball; and a communication module operatively coupled to the sensor arrangement and configured to transmit the measured acceleration and rotational data to a processing unit. The processing unit generates a series of sequential measurements corresponding to the measured acceleration and rotational data, calculates a variance using a set of sequential measurements from the series of sequential measurements, and detects a contact event if the calculated variance exceeds a predefined event threshold. Disclosed also is a sports management system.

14 Claims, 5 Drawing Sheets

INTERACTIVE SPORTS BALL AND SPORTS MANAGEMENT SYSTEM

TECHNICAL FIELD

The present disclosure relates to interactive sports balls. Moreover, the present disclosure relates to sports management systems.

BACKGROUND

In sports such as basketball, volleyball and so on, it is imperative to accurately determine when, for how long, and in which manner the ball has been contacted (for example, whether by a catch, grab, dribble, deflection, slap, push, poke, tap, touch, or some other interaction) by players. Traditional monitoring and detection systems, use video or recordings of a game to determine such events. However, assessment and determination based on video review alone lack accuracy and have margin of errors in judgement leading to imprecise and inefficient management during the game. In other words, the traditional monitoring and detection systems using video review alone are inadequate for reliably detecting all types of contacts. Additionally, in games, violations such as goaltending, where a player contacts the ball on its downward flight, are difficult to detect in real-time. The traditional monitoring and detection systems are particularly inefficient for detecting minor contacts for example before the ball goes out of bounds or violations such as goal tending.

One of the problems with current system that accurate game clock control system is lacking. Adjusting game clock timings require video analysis as an example. For game clock management, usual practice is that referees rely on visual cues to stop the game clock by blowing their whistle when the ball is perceived to have gone out of bounds or through the net. This process can involve human delays and lacks precision. Furthermore, the traditional monitoring and detection systems lack required features to enable precise operation of the game clock.

Therefore, considering the foregoing discussion, there exists a need to overcome the aforementioned drawbacks.

SUMMARY

The aim of the present disclosure is to provide an interactive sports ball to gather data pertaining to various events on which a ball is in contact with a player, ground, a basket, an object, a spectator, a person, a floor etc. In addition, the data can be gathered related to events during a game or practice. Also, the aim of the present disclosure is to provide a sports management system comprising the interactive sports ball where the sports management system is configured to identify the time stamps of the various events during a game and a player associated with the contact events (from the data gathered by the interactive sports ball) as well as provide relevant video data to referee or any such authority thereby making the decision process during a game smooth and enhancing sport management quality. The aim of the present disclosure is achieved by an interactive sports ball and a sports management system as defined in the appended independent claims to which reference is made to. Advantageous features are set out in the appended dependent claims.

Throughout the description and claims of this specification, the words "comprise", "include", "have", and "contain" and variations of these words, for example "comprising" and "comprises", mean "including but not limited to", and do not exclude other components, items, integers or steps not explicitly disclosed also to be present. Moreover, the singular encompasses the plural unless the context otherwise requires. In particular, where the indefinite article is used, the specification is to be understood as contemplating plurality as well as singularity, unless the context requires otherwise.

DETAILED DESCRIPTION OF EMBODIMENTS

Figure 1:
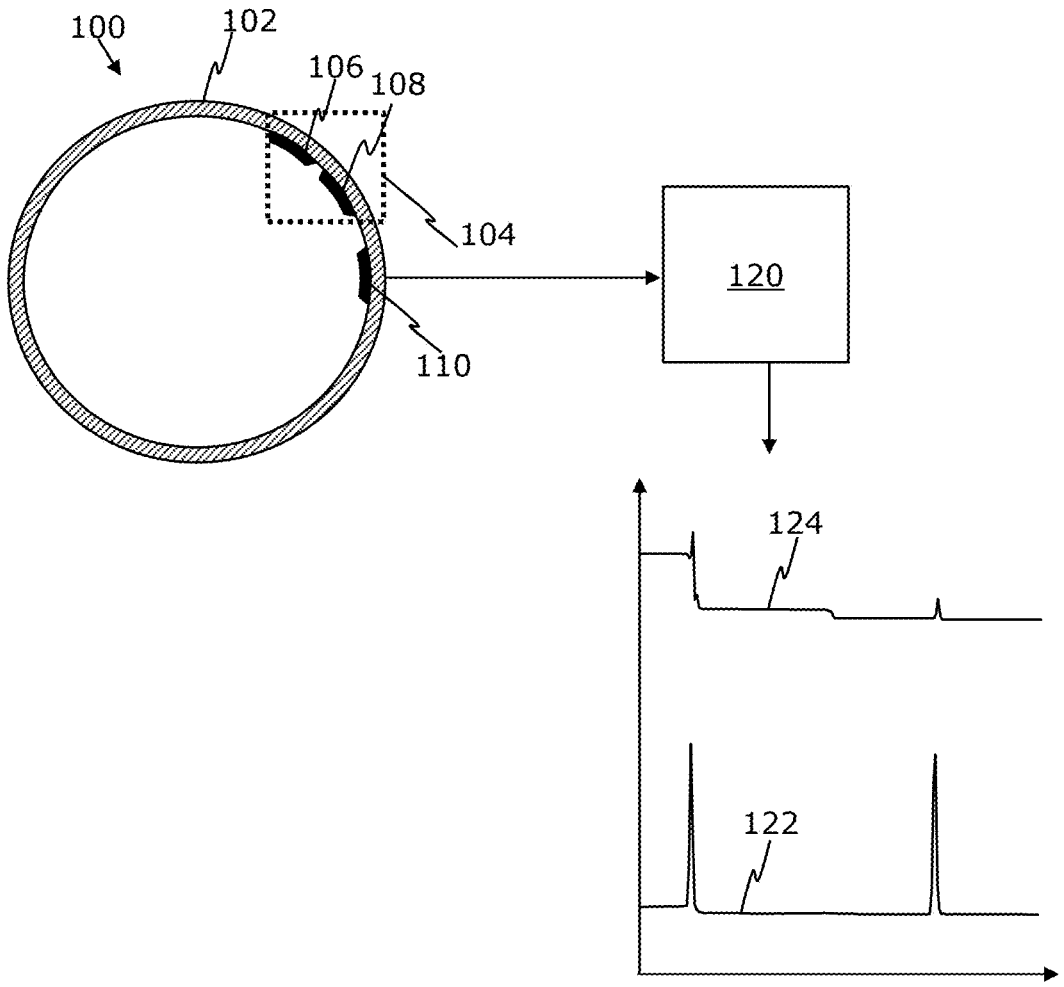
FIG. 1 is a schematic illustration of an interactive sports ball, in accordance with an embodiment of the present disclosure.

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In a first aspect, the present disclosure provides an interactive sports ball comprising:

- a body;
- a sensor arrangement having
  - a first sensor, embedded within the body, to measure acceleration data associated with the ball, and
  - a second sensor, embedded within the body, to measure rotational data associated with the ball; and
- a communication module operatively coupled to the sensor arrangement and configured to transmit the measured acceleration and rotational data to a processing unit, wherein the measured acceleration and rotational data is received and processed by the processing unit to:
- generate a series of sequential measurements corresponding the measured acceleration and rotational data,
- calculate a variance using a set of sequential measurements from the series of sequential measurements, and
- detect a contact event if the calculated variance exceeds a predefined event threshold.

The aforementioned interactive sports ball provides real-time data corresponding to change in acceleration or rotation of the interactive sports ball. The aforementioned interactive sports ball also incorporates transmission facility for such relaying such contact events, thereby beneficially eliminating any time lag in responding to any conflict when arises during a game. By integrating advanced sensor technology directly into a ball used in the game, the aforementioned interactive sports ball provides most accurate data for every contact (a light contact, or a carry) thus improving accuracy of contact detection and game transparency. In a second aspect, the present disclosure provides a sports management system comprising:

an interactive sports ball, comprising:
- a body;
- a sensor arrangement having
  - a first sensor, embedded within the body, to measure acceleration data associated with the ball, and
  - a second sensor, embedded within the body, to measure rotational data associated with the ball; and
- a communication module operatively coupled to the sensor arrangement and configured to transmit the measured acceleration and rotational data;

a processing unit communicably coupled to the communication module to receive the measured acceleration and rotational data, wherein the processing unit is configured to:
- generate a series of sequential measurements corresponding the measured acceleration and rotational data,
- calculate a variance using a set of sequential measurements from the series of sequential measurements, and
- detect a contact event if the calculated variance exceeds a predefined event threshold;

an imaging system for generating visual data of an interactive sports game; and a server, operatively coupled to the imaging system and the processing unit, configured to synchronize the detected contact event with the generated visual data to enable management of the interactive sports game.

The aforementioned sports management system is advantageously configured to enhance game time accuracy by enabling precise control over when the game clock should stop based on real-time sensor data pertaining to an exact time when the interactive sports ball hits an external object. The communicable coupling of the interactive sports ball with an imaging system and server enables the aforementioned sports management system to create a real-time, reliable detection system that can capture both subtle and significant interactions with the ball, while also being able to detect when the ball is carried over time by a player. The aforementioned sports management system is also configured to also address the need for more precise clock management by using sensor data from the interactive sports ball to stop a game clock at the exact moment the interactive sports ball hits an external object, ensuring more accurate in-game timekeeping. The aforementioned sports management system beneficially provides accurate in-game monitoring and management facility by using the interactive sports ball having smart detection and data transmission features (namely, the sensor arrangement and communication unit). Moreover, by analysing obtained sensor data in real-time, by calculating the variance of the measurement values, the aforementioned sports management system provides accurate contact detection during the game. Furthermore, the aforementioned sports management system is configured to accurately identify when the ball is contacted (touched) and which player is involved in the contact, by utilizing the imaging system, processing unit, and server. Term "contact event" or "contact" in this disclosure refers to physical interaction between interactive sports ball and an arbitrary object. An example ball is in contact with a player (i.e. player touches the ball), the ball hits rim (i.e. is momentarily in contact with the rim), ball bounces on the floor (thus is in contact with the floor), or when a ball is in contact with object out of bounds. The contact event in practical terms describes a moment of time when this type of contact starts, takes place, or when the contact ends.

The term "variance" in this disclosure refers to descriptive statistic describing difference of a measurement value from a baseline. As an example, difference of a measurement value of interest in respect to measurements made before and/or after the measurement value of interest. As an example 4 measurements before and 4 after the measurement value of interest.

Throughout the disclosure the term "interactive sports ball" (or, simply referred to as the ball) refers to a technologically enhanced ball equipped with electromechanical components such as, but not limited to, sensors and communication systems, to enable real-time data transmission associated with the movement and interaction of the ball. The interactive sports ball allows measurement of metrics such as acceleration, rotation, and force, to enable tracking of trajectory, speed, rotation or spin, and other dynamic properties, associated with the ball. Typically, the interactive sports ball may be utilized in any conventional sport such as, basketball, football, volleyball, etc., while providing an immersive and engaging experience for users by integrating technology into traditional gameplay, training, or competitive environments.

The interactive sports ball comprises a body. The term "body" refers to the primary structure of the interactive sports ball operable to serve as a physical container for the other components of the interactive sports ball. The body may be made of materials such as, rubber, leather, synthetic alternatives, or a combination thereof. The body of the interactive sports ball may include an internal structure that securely holds the components without compromising bounce or grip such as, dedicated compartments, slots, or grooves, to effectively accommodate technical equipment therein. It will be appreciated that the material, size, shape and design of the interactive sports ball is dependent on the type of sport being played and thereby may be varied without any limitations to the present disclosure. The body of the interactive sports ball is designed to look and feel like a regulation ball but contains embedded technology that enhances its functionality. In an example, the interactive sports ball may be a regulation-size basketball with a durable synthetic leather exterior, housing internal sensors without compromising performance or feel during gameplay.

The interactive sports ball further comprises a sensor arrangement. The "sensor arrangement" refers to the configuration of sensors embedded within the interactive sports ball to capture data regarding movement and interaction thereof. The sensor arrangement includes a collection of sensors embedded within the body of the interactive sports ball to effectively and accurately measure various ball parameters. In an example, the sensor arrangement includes an accelerometer to measure how the ball's velocity changes and a gyroscope to detect the ball's rate of rotation during play. The sensor arrangement may comprise at least one of an accelerometer, a gyroscope, a Global Positioning System (GPS), Inertial measurement unit (IMU), a camera, a radar sensor, a LiDAR sensor, and the like. Beneficially, the sensor arrangement enables monitoring of complex motion data such as, acceleration and rotational data, to be further processed and utilized for feedback on game statistics, skill improvement, or enhanced gameplay experiences.

Moreover, the sensor arrangement comprises a first sensor, embedded within the body, to measure acceleration data associated with the ball. Typically, the first sensor is configured to measure the linear acceleration of the interactive sports ball, including its speed, direction, and changes in velocity. The first sensor provides essential feedback on the velocity and acceleration of the ball, allowing for precise movement tracking.

Moreover, the sensor arrangement comprises a second sensor, embedded within the body, to measure rotational data associated with the ball. Typically, the second sensor is configured to measure rotation and changes in rotation along axis(es) of the ball.

Optionally, the first sensor is an accelerometer, and the second sensor is a gyroscope. In this regard, for example, the first sensor may be a 3-axis accelerometer, providing data in the X, Y, and Z directions. In this regard, for example, the second sensor may be a 3-axis gyroscope, providing data in the X, Y, and Z directions. The technical advantage is enhanced accuracy of measurement. Optionally, the data (acceleration and rotational) associated with the interactive sports ball from the first sensor and second sensor, are transmitted to the processing system via Bluetooth or any such transmission protocol.

Optionally, the sensor arrangement further comprises a third sensor, embedded within the body, to measure positional data associated with the ball.

The interactive sports ball further comprises a communication module operatively coupled to the sensor arrangement and configured to transmit the measured acceleration and rotational data to a processing unit. The communication module is configured to wirelessly transmit data from the sensor arrangement to a processing unit for further utilization. The communication module is operatively coupled with the sensor arrangement and is responsible for transmitting the data (both acceleration and rotational) to a processing unit. Notably, the data transmission is done in real-time, ensuring that the data can be processed and analyzed quickly during a game.

The term "processing unit" as used herein refers to a structure and/or module that includes programmable and/or non-programmable components configured to store, process and/or share data and/or signals to generate meaningful insights or information associated with the interactive sports ball. The processing unit may have elements, such as a display, control buttons or joysticks, processor, memory and the like. Optionally, the processing unit includes any arrangement of physical or virtual computational entities capable of enhancing information to perform various computational tasks. Optionally, the processing unit is supplemented with additional computation systems, such as neural networks, and hierarchical clusters of pseudo-analog variable state machines implementing artificial intelligence algorithms. In the present examples, the processing unit may include components such as memory, a controller, a network adapter and the like, to store, process and/or share information with other components, such as, the sensor arrangement, a remote server unit, a database. Optionally, the processing unit is implemented as a computer program that provides various services (such as database service) to other devices, modules or apparatus. The processing unit is communicably coupled to the communication module wirelessly and/or in a wired manner. In an example, the processing unit may be implemented as a programmable digital signal processor (DSP). In another example, the processor may be implemented via a cloud server that provides a cloud computing service. In some implementations, the processor is integrated with the interactive sports ball. In other implementations, the processing unit is implemented separate from the interactive sports ball. Moreover, the processing unit refers to a computational element that is operable to respond to and processes instructions for management of the electric grid. Optionally, the processing unit includes, but is not limited to, a microcontroller, a micro-controller, a complex instruction set computing (CISC) microcontroller, a reduced instruction set (RISC) microcontroller, a very long instruction word (VLIW) microcontroller, Field Programmable Gate Array (FPGA) or any other type of processing circuit, for example as aforementioned. Beneficially, the processing unit enables the system and/or the method to effectively manage the electric grid and to ensure a safe and robust performance thereat. Optionally, the processing unit is communicably coupled to a data repository. It will be appreciated that processed data is stored at the data repository. The data repository is optionally implemented as a memory. The memory may be local memory that is integrated with the processing unit, or an external memory, or a cloud-based memory, or similar.

The transmitted data is thereby processed by the (external or internal) processing unit, to render the received raw data (i.e., the acceleration and the rotational data) into a series of sequential data sets (or time series). Herein, the measured acceleration and rotational data associated with the ball is processed via the processing unit to generate a series of sequential measurements. Typically, the transmitted raw data is sequentially organized based on the associated time stamps and thereby arranged in a preferred manner for enabling further utilization thereof. The processing unit thereby analyses the generated series of sequential measurements (captured at a high frequency, e.g., 200 Hz) to derive useful information therefrom.

Optionally, the processing unit is configured to select the set of sequential measurements from the series of sequential measurements based on a dynamic sliding window. In this regard, the term dynamic sliding window refers to a measurement technique in calculating the variance (or another statistic) to analyze generated series corresponding to the acceleration and rotation data time-series data (such as sensor data) in small, sequential segments (windows) to detect changes or patterns over time. In the context of calculating the variance, the sliding window technique is used to compute the variance of the data within each window and observe how this statistic changes as the window moves. In this regard, the set of sequential measurements refers to a specific number of measurements which are measured by the sensor arrangement (namely the first and the second sensor) in a consecutive manner one after the other. The technical effect is to generate a series, specifically time series, to easily perform the calculations needed to identify contact events. Optionally, the size of the dynamic sliding window is defined by the set of sequential measurements having 3 to 25 sequential measurements. In this regard, the size of dynamic sliding window is defined as per the set of sequential measurements, specifically as per the number of measurements which are to be considered to determine a contact event while performing the calculation of variance. The dynamic sliding window is configured to slide across the generated series corresponding to acceleration and rotational data associated with the interactive ball. While sliding, any value (namely variance value of acceleration and rotation) that exceeds the predefined event threshold is identified. The size of dynamic sliding window may be an odd number if the sliding window is symmeric. For example, the size of the dynamic sliding window may be 3, 5, 7, 9, 11, 13, 15, 17, 19, 21, or 23 up to 5, 7, 9, 11, 13, 15, 17, 19, 21, 23, or 25 sequential measurements, as per data volume generated by the sensor arrangement. The sliding window can be also other integer such as 3, 4, 5, 6, 7, 8, 9, 10, 11, 12, 13, 14, 15, 16, 17, 18, 19, 20, 21, 22, 23, 24, 25 or 26. Preferably, the size of the dynamic sliding window is 9 or 17 based on the set of sequential measurements. The technical advantage is accurate measurement of contact event due to optimized dynamic sliding window size.

Optionally, the first sensor and the second sensor are configured to measure the acceleration data and the rotational data, respectively, at a sampling rate of 100 Hz to 500 Hz. In this regard, the first sensor and the second sensor are configured to measure the acceleration and rotational data of the interactive sports ball at the defined sampling rate. The term sampling rate refers to a measurement rate at which the first sensor and the second sensor are configured to measure the acceleration and rotational data of the interactive sports ball. Optionally, the preferable sampling rate may be from 100, 150, 200, 250, 300, 350, 400 or 450 Hz up to 150, 200, 250, 300, 350, 400, 450, or 500 Hz. Optionally, the sampling rate is preferably 200 Hz or 400 Hz. By setting the sampling rate at aforementioned values, the optimal collection of sample data (namely, data associated with the interactive sports ball) can be done. Optionally, the sampling rate is associated with the set of sequential measurements defining the size of the dynamic sliding window. In this regard, the sampling rate defines how frequently the measurement of acceleration and rotational data is performed. However, frequent measurement does not always provide more reliable data for accurate analysis. Setting an optimum sampling rate is essential for determining the contact event. In this regard, it may be appreciated that the sampling rate is defined as per the size of the dynamic sliding window. For example, when the dynamic sliding window size is 9 (4+1+4) the sampling rates of the first sensor and the second sensor measuring acceleration and rotational data are set at 200 Hz. For another example, when the dynamic sliding window size is 17 (8+1+8) the sampling rate is set at 400 Hz. For yet another example, when the dynamic sliding window size is 5 (2+1+2) the sampling rate may be set at 100 Hz. Similarly, when the dynamic sliding window size is 7 (3+1+3) the sampling rate may be set at a suitable sampling rate. The technical advantage is optimization of measurement rate thereby providing sufficient and adequate data for contact detection. In general then window size depends on the dynamics of the sports ball and the sport in question. As an example, if the contacts of interest create "signals" within, say, 0.10 second range, the window should be relative to this range.

Optionally, the processing unit is further configured to compute and associate a time stamp corresponding to each detected contact event. In this regard, processing unit utilizes the dynamic sliding window to identify values of variance for both acceleration and rotational data associated with the interactive sports ball, which exceeds the predefined event threshold. Upon identifying the variance exceeding predefined event threshold, the processing unit is configured to identify and associate the time stamp corresponding to contact event detected from such variance data. The technical advantage is accurate determination of time at which the contact event happens from the acceleration and rotational data associated with the interactive sports ball.

Optionally, the processing unit is further configured to identify rhythmic fluctuations in the calculated variance based on the associated time stamps to detect an event such as a ball being carried. In this regard, the processing unit is configured to determine the type of contact event from the rhythmic fluctuations in the calculated variance. Notably, a momentary contact such as slightly touching the ball and long contact such as carrying it affect the acceleration and rotation of the interactive sports ball differently. Changes in the acceleration and rotation data are distinct when considering the contact event type. Such changes are analyzed by the processing unit to separate free flights from possible false positive free flights produced by carrying of the ball. In this regard, the variance of acceleration and rotational data over a period of time shows a rhythmic pattern that corresponds to the hand movements of the player. This pattern may be flagged by the processing unit as a carrying event. Optionally, the processing unit may also implement algorithms such as e.g., decision trees, neural networks, or support vector machines to categorize contact events. For example, during a game of basketball legal dribble is identified when the interactive sports ball follows a specific pattern of deceleration as it contacts the hand and acceleration as it leaves. Prolonged periods of low acceleration could indicate a carry. Such patterns are reflected on the variance of acceleration and rotational data captured by the first sensor and second sensor. From such pattern/fluctuation, the processing unit determines the contact event type i.e., if it's a carry event. The technical advantage is accurate determination of contact event type, i.e., if it's a slight contact or carry event, thereby providing resolution to conflicts during the game.

Optionally, the processing unit is further configured to transmit a command signal to a game device upon detection of the contact event or the carry event. In this regard, the processing unit is communicably coupled with the game device. The game device may be a monitoring device, alert device or so on providing an indication in forms of visual or auditory alerts to a referee or any such concerned person who is authorized to intervene in a game in continuation. The processing unit sends the command signal which is perceived at the game device as the contact event has happened. The game device may also regulate a game clock which records duration of game. In this regard, the game clock functions like a stopwatch and needs to be stopped when a ball (namely the interactive sports ball) goes out of bounds. The game device is configured to receive data on the ball when the ball contacts the ground or contacts external object which is deemed to be out of bound. The technical advantage of automatic and instant operation (stopping or resuming) of the game clock thereby enhancing quality of game.

The present disclosure also relates to the sports management system as described above. Various embodiments and variants disclosed above, with respect to the aforementioned interactive sports ball, apply mutatis mutandis to the sports management system.

Throughout the disclosure, the term "sports management system" refers to a comprehensive system capable of monitoring a game, analyzing data associated with the interactive sports ball, alerting when violation of game rules occurs, providing review material to referee of the game and manage game clock based on the data associated with the interactive sports ball.

Throughout the disclosure, the term "imaging system" refers to at least one camera arranged to capture and transmit visual data pertaining to the game for further analysis.

Throughout the disclosure, the term "server" refers to integrated unit coupled with various components of the sports management system to receive data, to adjust settings, to provide output, as per requirements of the game. Optionally, the server is coupled with a data repository having stored therein a plurality of rules pertaining to the game. The server may also utilize various algorithms to analyze data received and generate output. In this regard, the server is configured to receive data on contact event detected from the processing unit. The server identifies the time stamp of contact event. The server also receives the visual data from the imaging system. The server maps the time stamp identified onto the visual data received (as string of video frames), thereby identifying the exact video frame that corresponds to the time stamp identified. The server may be configured to relay information pertaining to the exact video frame corresponding to the time stamp identified, to a user interface such as a monitor, a display screen, and so one for the referee to review. Moreover, the server is configured to operate a game clock based on the identified time stamp when the interactive sports ball goes out of bounds or contacts ground, external object, any spectator, a player outside court (playing area).

Optionally, the server is further configured to detect a contact event based upon analysis of the contact events synchronized with the visual data. In this regard, the server analyses data received from the processing unit and the image system by synchronizing the time stamp associated with contact event which may be event such as touching ground, going out of bounds, or making contact with an external object. Upon synchronization, the server identifies if a player is related to the contact event or not. If the ball contacts the ground, then the server determines that a event has happened and initiates further actions which are protocoled to be performed in such cases. The technical advantage is accurate determination of contact event. Moreover, the synchronization between the sensor data and the video frames enhances the precision and objectivity of refereeing decisions during the game.

Optionally, the server is further configured to provide real-time video playback of the synchronized contact events. The server is configured to retrieve the relevant video in real-time and play the same in a display device such as a monitor, for referee review. The technical advantage is visual confirmation of conflict moments related to contact event. Further optionally the server can be configured to provide pointers to the video relating to moments of time when no contact is detected.

Optionally, the processing unit is further configured to modify the predefined event threshold based on either gameplay conditions or manual input. In this regard, the modification is performed on the basis of game rules. The modification may be initiated by an automatic update based on game types, or manually based on real-time situation. The technical advantage is dynamic adaptability to real-time situations.

Optionally, the server is further configured to transmit a command signal to a game device upon occurrence of the contact event. In this regard, the term command refers to an instruction or message in any suitable format to generate an alert, a notification or adjust settings of the components of the sports management system.

Optionally, the imaging system generates the visual data at a frame rate of 240 frames per second, and wherein the processing unit is configured to match the detected contact events to corresponding frames within the visual data. In this aspect, the sampling rate of the imaging system is defined on the basis of the size of the dynamic sliding window of the processing unit. Optionally, the sampling rate is set at 200 Hz when the size of the dynamic sliding window of the processing unit is 9 and the sampling rate is 400 Hz when the size of the dynamic sliding window of the processing unit is 17. It may be appreciated that a midpoint of 9 (4+1+4) sequential measurement is assumed to be the time of a contact event. Similarly, a midpoint of 17 (8+1+8) sequential measurement is assumed to be the time of a contact event. For example, when a size of the dynamic sliding window of the processing unit is 9, then the processing unit is configured to detect a contact event from 9 sequential measurements whose variance data exceeds the predefined event threshold, determining that a contact event to have occurred at a midpoint of these 9 sequential measurements. In this regard, to optimally capture relevant data the imaging system operation is set at the sampling rate of 200 Hz. Similarly, for size of the dynamic sliding window of the processing unit is 17, the contact event is determined to have occurred at a midpoint of these 17 sequential measurements with variance exceeding the predefined event threshold. For this scenario, the sampling rate is set at 400 Hz. Optionally, the sampling rate may be modified as per requirements such as type of game being played, size of the interactive sports ball, and so on. In this regard, while the first sensor and the second sensor can operate at different sampling rates (e.g., 200 Hz or 400 Hz), the critical aspect of is finding an optimal number of sequential measurements for the calculation of variance rather than solely increasing the sampling rate. The technical advantage is optimizing data capture rate as per data processing to accurately detect contact events.

Using only accelerometer or gyroscope to implement sensor-based contact detection system limits detection capabilities to certain types of contacts, and might fail to detect contacts that don't impact acceleration or rotation. Therefore, in preferred embodiment both the gyroscope and the accelerometer measurements are used.

Additional embodiment is to use moment of time when a player's contact ends to determine if the basketball was released from the player's hand before the shot clock or game clock expires. That is, when the shot is released from the shooter's hand, we can record the moment of time and compare that with the game clock. If the game clock as >0 seconds left, then the shot counts. Similar approach can also be useful in determining, for example, if the ball was caught in the offensive half court before the expiration of the eight second clock.

Additionally, in basketball, the game clock starts when the ball is inbounded, and a player first contacts the ball inbounds. On the other hand, unlike in other games such as soccer, where the game play stops as soon as the ball crosses the vertical plane above boundary lines, in basketball the play continues until the ball actually lands out of bounds. That is, the game clock stops when the ball goes out of bounds and contacts an external object such as a player standing out of bounds, a wall, a part of the stadium structure, or even a spectator and their belongings. Furthermore, in late stages of a basketball game the game clock stops when a field goal is scored and the ball passes through the net. Overall, when the ball is inbounded, goes out of bounds, or passes through the net, the game clock must be started/stopped immediately to improve the quality and fairness of officiating. Therefore, in sports such as basketball, it is crucial to know the exact moment the ball contacts or stops contacting (touching) a player or an external object.

Experimental Part

The aforementioned interactive sports ball 100 and the sports management system 200 were used in professional sports such as basketball, where contact detection were critical for refereeing. Use of the aforementioned interactive sports ball 100 and the sports management system 200 allowed real-time monitoring and review of key moments during a game, providing referees with an objective tool to make decisions based on both sensor data (first sensor 106, second sensor 108) and synchronized video evidence (from imaging system 210). Additionally, the aforementioned interactive sports ball 100 and the sports management system 200 were used to manage game time more accurately in basketball by detecting the exact moment the interactive sports ball made contact with an external object and when interactive sports ball went out of bounds. Thus, enabling precise control over the game clock, improving the overall fairness and accuracy of the game.

Based on the use during a game the following data were obtained from the first sensor 106 of the interactive sports ball 100:

TABLE 1

| SAMPLE NUMBER | gTot | angTot | VARIANCE (gTot) | VARIANCE (angTot) |
|---|---|---|---|---|
| 19118 | 1.309984 | 8.17852 | −10.60056791 | −14.13267631 |
| 19119 | 1.309644 | 8.17907 | −11.33083441 | −14.23729526 |
| 19120 | 1.309236 | 8.178241 | −11.90428563 | −13.77993567 |
| 19121 | 1.308309 | 8.177007 | −11.59342963 | −13.82878132 |
| 19122 | 1.312883 | 8.176889 | −10.72500207 | −14.00205632 |
| 19123 | 1.313187 | 8.176382 | −9.952872387 | −14.96298976 |
| 19124 | 1.316937 | 8.177199 | −9.273134805 | −14.52485479 |
| 19125 | 1.321305 | 8.17734 | −8.905952813 | −14.23888513 |
| 19126 | 1.327615 | 8.177138 | −8.552022971 | −13.69230335 |
| 19127 | 1.336201 | 8.175325 | −8.326555569 | −13.69176149 |
| 19128 | 1.342846 | 8.175604 | −8.226874679 | −13.84674403 |
| 19129 | 1.350522 | 8.174631 | −8.123360246 | −13.95624652 |
| 19130 | 1.35936 | 8.176018 | −8.233269437 | −14.87369941 |
| 19131 | 1.365967 | 8.175482 | −8.399140415 | −14.8775846 |
| 19132 | 1.376559 | 8.17429 | −8.710116472 | −14.93850678 |
| 19133 | 1.378636 | 8.175141 | −9.165065882 | −14.91515004 |
| 19134 | 1.382257 | 8.175107 | −9.792956796 | −15.48591644 |
| 19135 | 1.384912 | 8.174796 | −10.70991534 | −15.90005808 |
| 19136 | 1.387208 | 8.17458 | −10.87772255 | −14.92748122 |
| 19137 | 1.386629 | 8.174411 | −11.42512666 | −14.24680251 |
| 19138 | 1.389434 | 8.174357 | −11.90623092 | −13.35891996 |
| 19139 | 1.391519 | 8.173456 | −12.4696889 | −13.41325332 |
| 19140 | 1.390754 | 8.172802 | −12.73809341 | −13.61725326 |
| 19141 | 1.391353 | 8.171313 | −13.69873682 | −13.54756844 |
| 19142 | 1.388748 | 8.172424 | −13.35061922 | −14.12587582 |
| 19143 | 1.389456 | 8.172703 | −11.47134053 | −14.55141919 |
| 19144 | 1.38984 | 8.171089 | −10.25886062 | −13.99201846 |
| 19145 | 1.392275 | 8.171827 | −8.532411528 | −13.469396 |
| 19146 | 1.398346 | 8.171509 | −6.902563023 | −12.719443 |
| 19147 | 1.40483 | 8.169941 | 1.837914624 | −3.866734257 |
| 19148 | 1.427681 | 8.169557 | 4.571927539 | −1.746252072 |
| 19149 | 1.47652 | 8.167528 | 4.607985898 | −0.675256132 |
| 19150 | 8.046473 | 7.787526 | 4.584194238 | −0.094792957 |
| 19151 | 27.71197 | 7.067712 | 4.579845157 | 0.458322423 |
| 19152 | 14.34852 | 9.472929 | 4.594090431 | 0.605288786 |
| 19153 | 2.562412 | 6.464448 | 4.611865016 | 0.614318251 |
| 19154 | 1.596458 | 5.663553 | 4.680353398 | 0.588540755 |
| 19155 | 0.827879 | 5.924417 | 3.224967845 | 0.602485177 |
| 19156 | 0.709154 | 5.907864 | −0.655766914 | −2.811029818 |
| 19157 | 0.890972 | 5.885935 | −2.129432478 | −4.832312311 |
| 19158 | 0.633866 | 5.888513 | −4.502168948 | −8.330203058 |
| 19159 | 0.606373 | 5.887173 | −4.708421686 | −9.507637376 |
| 19160 | 0.6822 | 5.884986 | −4.691476263 | −12.05976342 |
| 19161 | 0.657465 | 5.883553 | −7.547657329 | −11.85360979 |

Figure 5A:
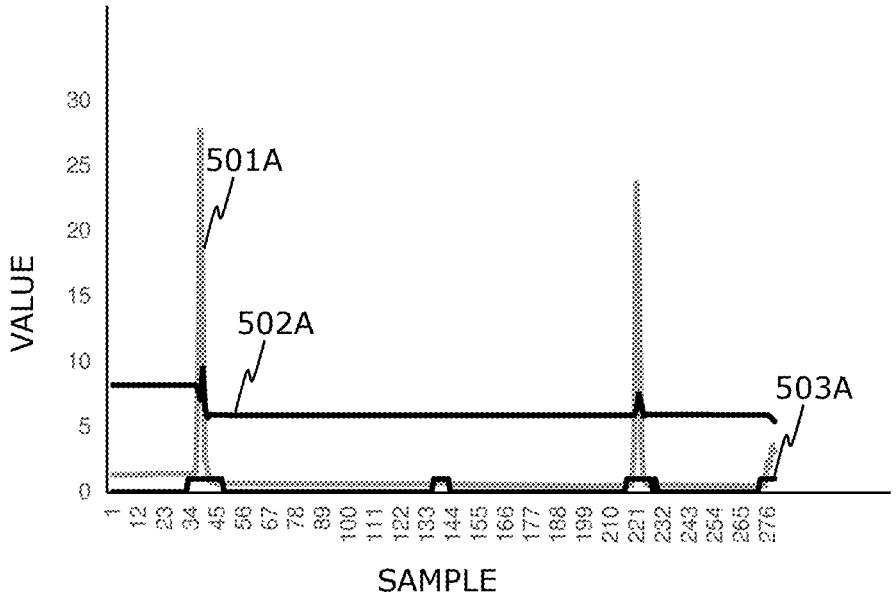
FIG. 5A is a graphical illustration of data pertaining to first sensor of the interactive sports ball of FIG. 1, in accordance with an embodiment of the present disclosure.

The obtained data was plotted as a graphical illustration in FIG. 5A. From the calculation of variance with a dynamic sliding window over 7 sequential measurements, contact detection was carried out. It may be appreciated that the first sensor 106 measured acceleration due to rotation during free flight (gTot) at time T, which corresponds to flight of the interactive sports ball 100 and a value of variance was estimated for the acceleration of the interactive sports ball from such measurement. The first sensor 106 also measured angular rotation (angTot) which corresponds to rotation or spin of the interactive sports ball 100 and a value of variance was estimated for the angular rotation of the interactive sports ball from such measurement.

Similarly, based on the use during a game the following data were obtained from the second sensor 108 of the interactive sports ball 100:

TABLE 2

| SAMPLE NUMBER | gTot | angTot | VARIANCE (gTot) | VARIANCE (angTot) |
|---|---|---|---|---|
| 2316 | 1.350522 | 8.174631 | −8.123360246 | −13.95624652 |
| 2317 | 1.35936 | 8.176018 | −8.233269437 | −14.87369941 |
| 2318 | 1.365967 | 8.175482 | −8.399140415 | −14.8775846 |
| 2319 | 1.376559 | 8.17429 | −8.710116472 | −14.93850678 |
| 2320 | 1.378636 | 8.175141 | −9.165065882 | −14.91515004 |
| 2321 | 1.382257 | 8.175107 | −9.792956796 | −15.48591644 |
| 2322 | 1.384912 | 8.174796 | −10.70991534 | −15.90005808 |
| 2323 | 1.387208 | 8.17458 | −10.87772255 | −14.92748122 |
| 2324 | 1.386629 | 8.174411 | −11.42512666 | −14.24680251 |
| 2325 | 1.389434 | 8.174357 | −11.90623092 | −13.35891996 |
| 2326 | 1.391519 | 8.173456 | −12.4696889 | −13.41325332 |
| 2327 | 1.390754 | 8.172802 | −12.73809341 | −13.61725326 |
| 2328 | 1.391353 | 8.171313 | −13.69873682 | −13.54756844 |
| 2329 | 1.388748 | 8.172424 | −13.35061922 | −14.12587582 |

TABLE 2-continued

| SAMPLE NUMBER | gTot | angTot | VARIANCE (gTot) | VARIANCE (angTot) |
|---|---|---|---|---|
| 2330 | 1.389456 | 8.172703 | −11.47134053 | −14.55141919 |
| 2331 | 1.38984 | 8.171089 | −10.25886062 | −13.99201846 |
| 2332 | 1.392275 | 8.171827 | −8.532411528 | −13.469396 |
| 2333 | 1.398346 | 8.171509 | −6.902563023 | −12.719443 |
| 2334 | 1.40483 | 8.169941 | 1.120174211 | −5.345112107 |
| 2335 | 1.427681 | 8.169557 | 3.846491641 | −5.227030413 |
| 2336 | 1.47652 | 8.167528 | 3.865709898 | −2.009024744 |
| 2337 | 6.046473 | 7.987526 | 3.86061798 | −0.344257453 |
| 2338 | 19.71197 | 8.067712 | 3.870637491 | 0.019322522 |
| 2339 | 9.848515 | 9.072929 | 3.890080221 | 0.35040286 |
| 2340 | 1.562412 | 6.2644 | 3.914095657 | 0.461838925 |
| 2341 | 1.096458 | 6.464448 | 3.980761359 | 0.466958076 |
| 2342 | 0.827879 | 5.924417 | 2.441756316 | 0.30114723 |
| 2343 | 0.709154 | 5.907864 | −2.126566682 | −2.897689686 |
| 2344 | 0.690972 | 5.885935 | −3.56393895 | −3.072592566 |
| 2345 | 0.633866 | 5.888513 | −5.279410898 | −8.330203058 |
| 2346 | 0.606373 | 5.887173 | −6.66078731 | −9.507637376 |
| 2347 | 0.6822 | 5.884986 | −7.095661828 | −12.05976342 |

Figure 5B:
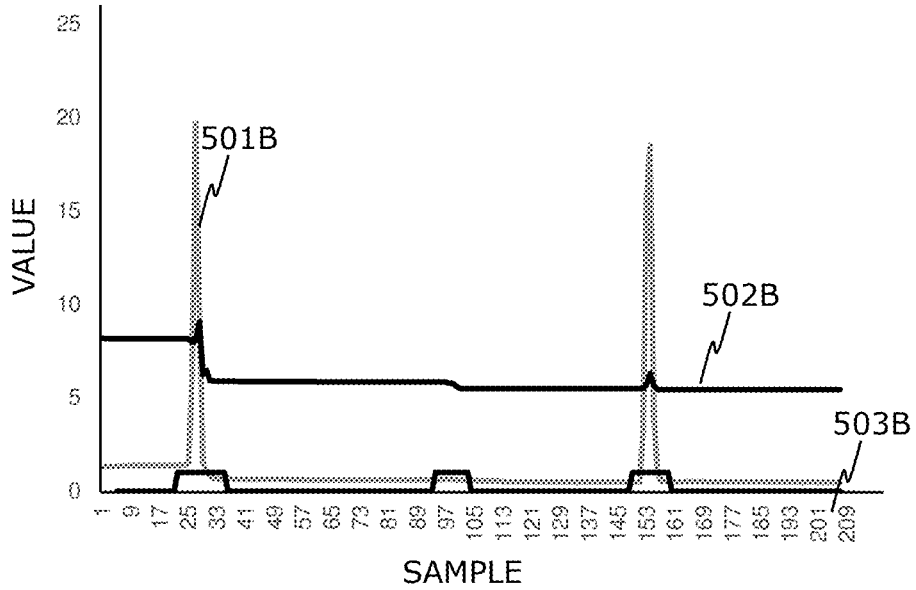
FIG. 5B is a graphical illustration of data pertaining to second sensor of the interactive sports ball of FIG. 1, in accordance with an embodiment of the present disclosure.

The obtained data was plotted as a graphical illustration in FIG. 5B. By calculating the variance of measurements with a dynamic sliding window over 7 sequential measurements, contact detection was carried out. In this regard, the second sensor 108 measured acceleration due rotation during the free flight (gTot) and angular rotation (angTot) for the interactive sports ball 100 and a value of variance was estimated for both measured acceleration and angular rotation, from such measurement. The variance measured is further utilized to detect a contact event and if the contact event is a slight contact or carry event.

DETAILED DESCRIPTION OF THE DRAWINGS

Referring to FIG. 1, illustrated is a schematic illustration of an interactive sports ball 100, in accordance with an embodiment of the present disclosure. As shown, the interactive sports ball 100 comprises a body 102, a sensor arrangement 104 and a communication module 110. The sensor arrangement comprises a first sensor 106, and a second sensor 108 embedded within the body 102. The first sensor 106 is configured to measure acceleration data associated with the ball, and the second sensor 108 is configured to measure rotational data associated with the interactive sports ball 100. The communication module 110 operatively coupled to the sensor arrangement 104. The communication module 110 is configured to transmit the measured acceleration and rotational data to a processing unit 120 communicably coupled to the communication module 110. The measured acceleration and rotational data associated with the interactive sports ball 100 is processed via the processing unit 120 to obtain a series of sequential measurements, calculate a variance of a set of sequential measurements from the series of sequential measurements, and detect a contact event if the calculated variance exceeds a predefined event threshold. Moreover, it may be appreciated that optionally, the first sensor 106 is an accelerometer and the second sensor 108 is a gyroscope. As shown, an output from the processing unit 120 is represented as graphical illustration having the X-axis representing time, while the Y-axis representing a magnitude of variance in the first sensor 106 and second sensor 108 readings. a first curve 122 which refers to data (at least one of: acceleration data, rotation data) from the first sensor 106 (i.e., an accelerometer) and a second curve 124 which refers to data (at least one of: acceleration data, rotation data) from the second sensor 108 (i.e., a gyroscope).

Figure 2:
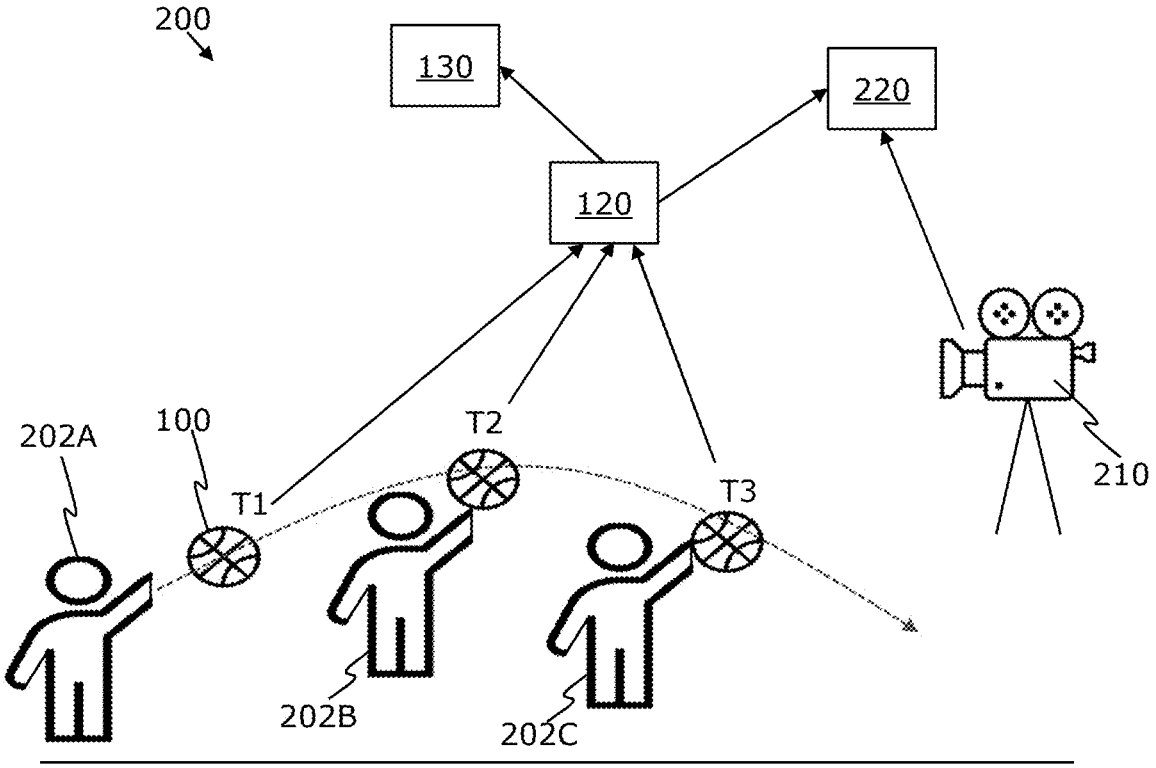
FIG. 2 is a schematic illustration of a sports management system, in accordance with an embodiment of the present disclosure.

Referring to FIG. 2, illustrated is a schematic illustration of a sports management system 200, in accordance with an embodiment of the present disclosure. As shown, the sports management system 200 comprises the interactive sports ball 100 transmitting the measured acceleration and rotational data to the processing unit 120, an imaging system 210 for generating visual data of an interactive sports game and a server 220, operatively coupled to the imaging system and the processing unit 120. The server 220 is configured to synchronize the detected contact events with the generated visual data to enable management of the interactive sports game.

Moreover, as shown in FIG. 2, at time T1, a first player 202A initiate a game by throwing the interactive sports ball 100 which moves along its trajectory without any change in rotation or acceleration. At time T2, the interactive sports ball 100 is contacted (touched) by a second player 202B slightly changing the rotation and/or acceleration. At time T3, a third player 202C makes contact with the interactive sports ball 100 which is detected by the first sensor 106 and the second sensor 108, and a corresponding change in the rotation and/or acceleration data is identified. The data pertaining to acceleration and rotational associated with the interactive sports ball 100, at time T1, T2 and T3 is transmitted by the communication unit 110 to the processing unit 120 of the sports management system 200. This way it is convenient to find from recorded video moments of time in which the ball was contacted and not contacted (i.e as an example moments of times when a player is starts to be in contact (touches the ball first time) with a ball, when the player is in contact with the ball and when the player release (stops touching the ball) the contact with the ball) In addition, the system might comprise a gaming device 130. The gaming device could be for example a game clock (timer) which could automatically stop when the ball hits ground outside of the play field.

Figure 3:
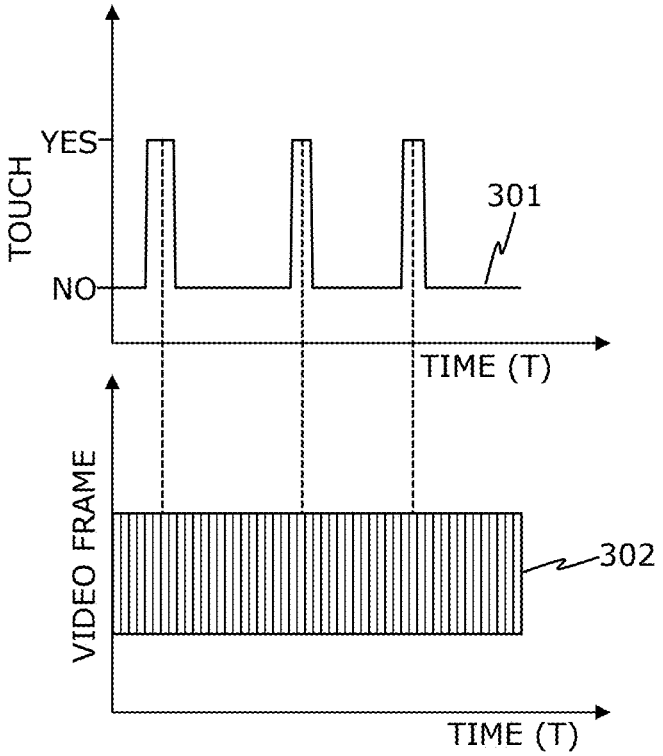
FIG. 3 is a graphical illustration of an operational output of a server of the sports management system of FIG. 2, in accordance with an embodiment of the present disclosure.

Referring to FIG. 3, illustrated is a graphical illustration of an operational output of a server 220 of the sports management system 200 of FIG. 2, in accordance with an embodiment of the present disclosure. As shown, the measured rotation and acceleration data associated with the interactive sports ball 100 is received in real time to by the processing unit 120 which is configured to process the measured acceleration and rotational data to obtain a series of sequential measurements, calculate a variance of a set of sequential measurements from the series of sequential measurements obtained and detect a contact event if the calculated variance exceeds a predefined event threshold. The server 220 of the sports management system 200 is configured to analyse the contact event to identify a time stamp associated with the contact event. The server 220 is configured to compare visual data of an interactive sports game generated by the imaging system 210 to identify video frame corresponding to the time stamp of the contact event detected. Moments of contact/no contact are illustrated with graph 301 in function of time. Recorded video frames are illustrated as 302 as function of time. This allows to find easily frames of interest.

Figure 4:
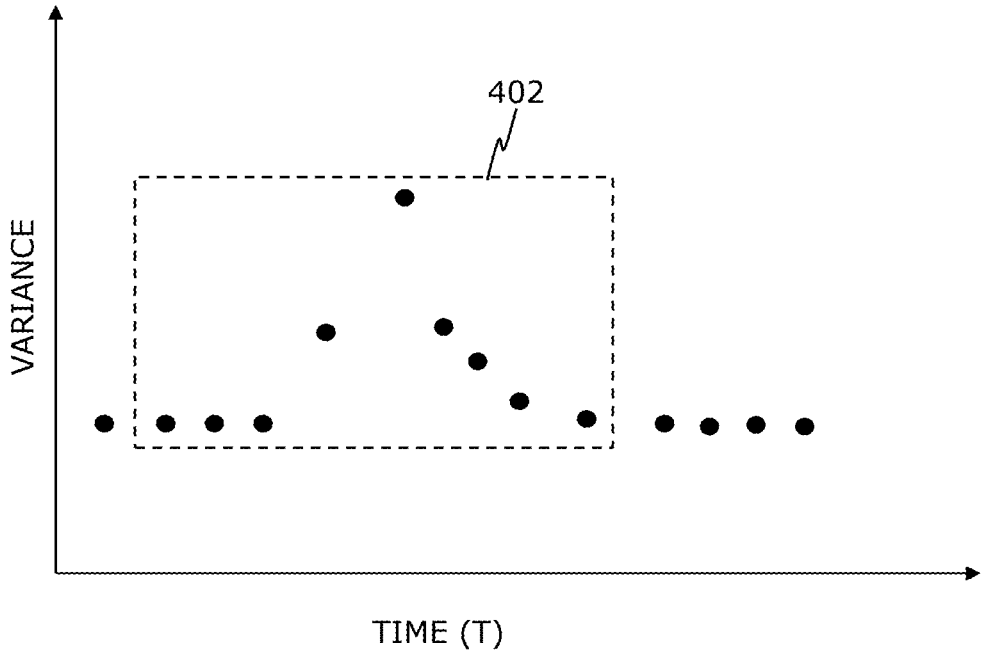
FIG. 4 is a graphical illustration of an operational output of a processing unit of the sports management system of FIG. 2, in accordance with an embodiment of the present disclosure.

Referring to FIG. 4, illustrated is a graphical illustration of an operational output of a processing unit 120 of the sports management system 200 of FIG. 2, in accordance with an embodiment of the present disclosure. As shown, the processing unit 110 analyses the measured rotation and acceleration data associated with the interactive sports ball 100, using a dynamic sliding window (box 402) over nine ('9') sequential measurements, identifying the exact times of contact, namely, T2 and T3. These time stamps are crucial for synchronizing the contact events with the visual data of an interactive sports game generated by the imaging system 210. As shown, the dynamic sliding window size is kept at 9 and the sampling rate is kept at 200 Hz.

Referring to FIG. 5A, illustrated is a graphical illustration of data pertaining to the first sensor 106 of the interactive sports ball 100 of FIG. 1, in accordance with an embodiment of the present disclosure. It may be appreciated that the first sensor 106 is an accelerometer capturing acceleration, and angular rotation. As shown, a data from the first sensor 106 is plotted. In this regard, variance of acceleration is plotted in curve 501A, variance in angular rotation is plotted in curve 502A, and change in free flight due to changes in acceleration and angular rotation is plotted in curve 503A. The spikes and dips in the curve 501A and curve 502A corresponds to change in curve 503A indicating a contact event happening.

FIG. 5B is a graphical illustration of data pertaining to second sensor of the interactive sports ball of FIG. 1, in accordance with an embodiment of the present disclosure. As shown, a data from the second sensor 108 is plotted. In this regard, variance of acceleration is plotted in curve 501B, variance in angular rotation is plotted in curve 502A, and change in free flight due to changes in acceleration and angular rotation is plotted in curve 503B. The spikes and dips in the curve 501B and curve 502B correspond to change in curve 503B indicating a contact event happening. It may be appreciated that by studying the variance of acceleration and angular rotation by the processing unit 120 having set a size of dynamic sliding window at 7 the contact event and type of contact event is determined.

The invention claimed is:

1. An interactive sports ball comprising:
a body;
a sensor arrangement having
a first sensor, embedded within the body, to measure acceleration data associated with the ball, and
a second sensor, embedded within the body, to measure rotational data associated with the ball; and
a communication module operatively coupled to the sensor arrangement and configured to transmit the measured acceleration and rotational data to a processing unit, wherein the measured acceleration and rotational data is received and processed by the processing unit to:
generate a series of sequential measurements corresponding the measured acceleration and rotational data,
calculate a variance using a set of sequential measurements from the series of sequential measurements, and
detect a contact event if the calculated variance exceeds a predefined event threshold; and the processing unit is configured to select the set of sequential measurements from the series of sequential measurements based on a dynamic sliding window.

2. The interactive sports ball according to claim 1, wherein the first sensor is an accelerometer, and the second sensor is a gyroscope.

3. The interactive sports ball according to claim 1, wherein a size of the dynamic sliding window is defined by the set of sequential measurements having 3 to 25 sequential measurements sequential measurements.

4. The interactive sports ball according to claim 1, wherein the first sensor and the second sensor are configured to measure the acceleration data and the rotational data, respectively, at a sampling rate of 100 Hz to 500 Hz.

5. The interactive sports ball according to claim 4, wherein the sampling rate is associated with the set of sequential measurements defining the size of the dynamic sliding window.

6. The interactive sports ball according to claim 1, wherein the processing unit is further configured to compute and associate a time stamp corresponding to each detected contact event.

7. The interactive sports ball according to claim 6, wherein the processing unit is further configured to identify rhythmic fluctuations in the calculated variance based on the associated time stamps to detect an event.

8. The interactive sports ball according to claim 1, wherein the processing unit is further configured to transmit a command signal to a game device upon detection of the contact event.

9. A sports management system comprising:
an interactive sports ball, comprising:
a body;
a sensor arrangement having
a first sensor, embedded within the body, to measure acceleration data associated with the ball, and
a second sensor, embedded within the body, to measure rotational data associated with the ball; and
a communication module operatively coupled to the sensor arrangement and configured to transmit the measured acceleration and rotational data;
a processing unit communicably coupled to the communication module to receive the measured acceleration and rotational data, wherein the processing unit is configured to:
generate a series of sequential measurements corresponding the measured acceleration and rotational data,
calculate a variance using a set of sequential measurements from the series of sequential measurements,
detect a contact event if the calculated variance exceeds a predefined event threshold, and the processing unit is configured to select the set of sequential measurements from the series of sequential measurements based on a dynamic sliding window;

an imaging system for generating visual data of an interactive sports game; and a server operatively coupled to the imaging system and the processing unit, configured to synchronize the detected contact event with the generated visual data to enable management of the interactive sports game.

10. The sports management system according to claim 9, wherein the server is further configured to detect event in a game based upon analysis of the contact events synchronized with the visual data.

11. The sports management system according to claim 9, wherein the server is further configured to provide real-time video playback of the synchronized contact events.

12. The sports management system according to claim 9, wherein the processing unit is further configured to modify the predefined event threshold based on either gameplay conditions or manual input.

13. The sports management system according to claim 9, wherein the server is further configured to transmit a command signal to a game device upon occurrence of the contact event.

14. The sports management system according to claim 9, wherein the imaging system generates the visual data at a frame rate of 240 frames per second, and wherein the processing unit is configured to match the detected contact events to corresponding frames within the visual data.

* * * * *